United States Patent [19]

Johnson

[11] 4,271,815

[45] Jun. 9, 1981

[54] PREFABRICATED FIREPLACE FOR PERMANENT INSTALLATION

[75] Inventor: William R. Johnson, Santa Cruz, Calif.

[73] Assignee: Chinook Manufacturing Co., Santa Cruz, Calif.

[21] Appl. No.: 92,486

[22] Filed: Nov. 8, 1979

[51] Int. Cl.[3] ..... F24B 7/00; F24C 1/14

[52] U.S. Cl. ..... 126/121; 126/77; 126/126; 126/143

[58] Field of Search ..... 126/120, 121, 123, 126, 126/131, 135, 136, 139, 143, 15 R, 15 A, 112, 77

[56] References Cited

U.S. PATENT DOCUMENTS

| | | | |
|---|---|---|---|
| 852,209 | 4/1907 | Watson | 126/77 |
| 2,863,443 | 12/1958 | Hoffman | 126/143 |
| 4,060,068 | 11/1977 | Lever | 126/143 |
| 4,076,012 | 2/1978 | Meeker | 126/143 |
| 4,095,581 | 6/1978 | Billmeyer et al. | 126/143 |
| 4,096,849 | 6/1978 | Moncrieff-Yeates | 126/143 |
| 4,153,036 | 5/1979 | Billmeyer et al. | 126/121 |
| 4,182,305 | 1/1980 | Johnson | 126/143 |
| 4,184,473 | 1/1980 | McIntire et al. | 126/121 |
| 4,194,487 | 3/1980 | Cadwallader et al. | 126/77 |
| 4,213,445 | 7/1980 | Mayo | 126/143 |

FOREIGN PATENT DOCUMENTS

| | | | |
|---|---|---|---|
| 776386 | 6/1957 | United Kingdom | 126/143 |
| 861001 | 2/1961 | United Kingdom | 126/143 |
| 872434 | 7/1961 | United Kingdom | 126/143 |

*Primary Examiner*—Daniel J. O'Connor
*Attorney, Agent, or Firm*—Robert G. Slick

[57] ABSTRACT

A prefabricated fireplace, largely made of metal, is provided for permanent installation in a house or similar structure. The fireplace is completely self-insulated so that it does not require any special materials of construction for installation and furthermore, combustion air is supplied for secondary combustion to prevent creosote buildup. Additionally, the fireplace does not use room air for combustion and is substantially airtight so that no room heat is lost up the chimney.

2 Claims, 4 Drawing Figures

PREFABRICATED FIREPLACE FOR PERMANENT INSTALLATION

SUMMARY OF THE INVENTION

The present invention relates to a prefabricated fireplace unit which is adapted for installation in the wall of a home or similar building.

Conventional fireplaces suffer from a number of deficiencies. Since they are ordinarily fabricated by hand from bricks or the like, they involve a large amount of hand labor. In contrast, the fireplace of the present invention is completely fabricated in a factory so that it can be merely slid into place in a suitable opening in a home and connected to a flue and an air inlet.

Another deficiency of normal fireplaces is that they have a tendency to build up soot or creosote deposits in the chimney or spark arrestor which creates a fire hazard when the chimney finally burns out. In accordance with the present invention this difficulty is solved by providing outlets for a portion of the combustion air near the top of the fireplace which results in secondary combustion and the elimination of soot or creosote deposits in the chimney.

Another purpose of the present invention is to provide a fireplace having a minimum amount of weight and this, in part, is achieved by providing air ducts within curtain walls of the firebox, greatly reducing the amount of refractory material required and, thus, the weight of the fireplace.

Another feature of the present invention is that it provides two completely different paths for combustion air and room air. The combustion air is drawn from the outside of the building so that it is not necessary to consume and waste the heated room air for combustion. Further, since entirely separate paths are provided for the room air and the combustion air, coupled with the fact that the fireplace itself is virtually airtight with respect to the room, warm air is not drawn from the air in the room at any time. Many fireplaces result in an actual loss of heat to the building due to sucking warm air from the room, particularly as the fire is dying down. As will be later apparent, this is substantially impossible with the fireplace of the present invention.

Another feature of the present invention is that the front air inlet is easily opened giving access to one or more fans which are optionally located within the room air intake.

A further feature of the present invention is that the combustion air is drawn from the bottom of the fireplace and travels a substantial distance over the floor of the fireplace, reducing the need for refractory material.

Other features and advantages of the invention will be brought out in the balance of the specification.

DESCRIPTION OF THE PREFERRED EMBODIMENTS

Figure 1:
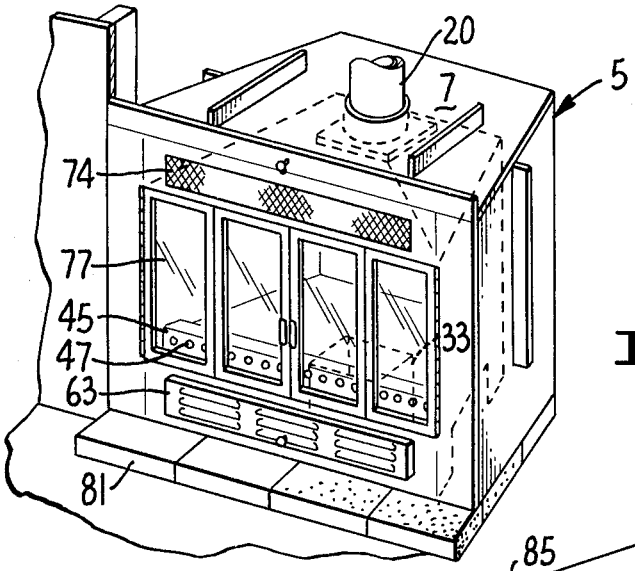
FIG. 1 is a perspective view of a fireplace embodying the present invention.

Referring now to the drawings by reference characters, the fireplace of the present invention is generally designated 5 and comprises a metal shell having a top wall 7, a back wall 9 and side walls 11 and 13. Located within the chamber thus formed is a firebox designated 15 having a top member 17 having walls tapering to a flue opening 19 and flue 20 and having side members 21 and a back member 23. The firebox also has a bottom number 25 and the back members 23 and the bottom 25 are lined with a refractory material 27 and 29. The outer shell of the fireplace, which was designated 5, has a double-wall construction at the sides and the top with an insulating material 29 filling the space between the double walls. This leaves a chamber between the firebox and the outer shell at the back, top and sides of the firebox.

The bottom of the fireplace is designated 31 and this has a central opening 33 wherein combustion air can be brought from the outside of the structure. Suspended above the bottom 31 is a partition 35 leaving a space 37 between the partition and the floor of the firebox. As can be seen, this space 37 extends completely under the floor of the fireplace so that the flow of combustion air keeps the fireplace cool so that a minimum of refractory material is needed on the bottom.

Figure 2:
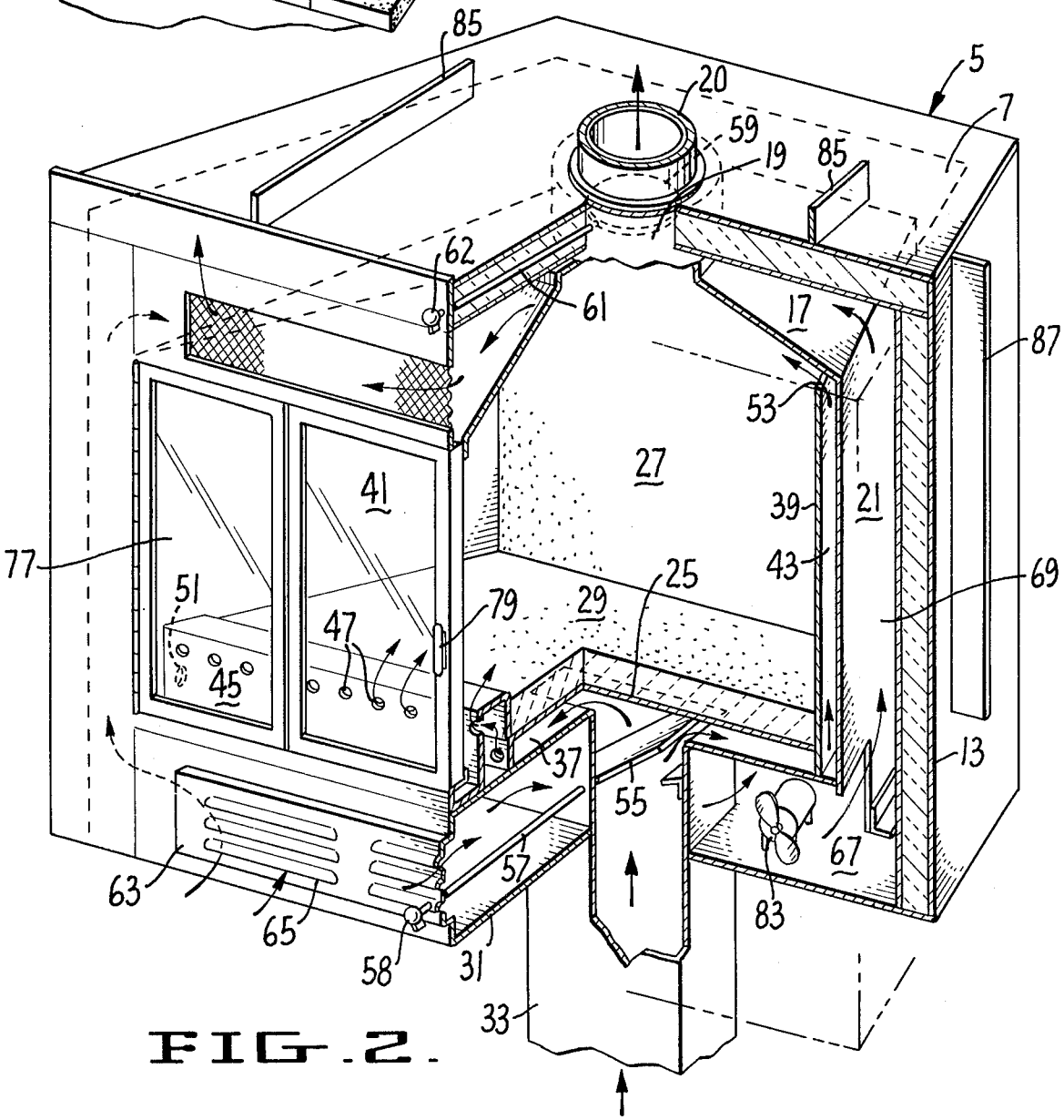
FIG. 2 is an enlarged perspective view of the fireplace showing some of the parts in section.
Figure 3:
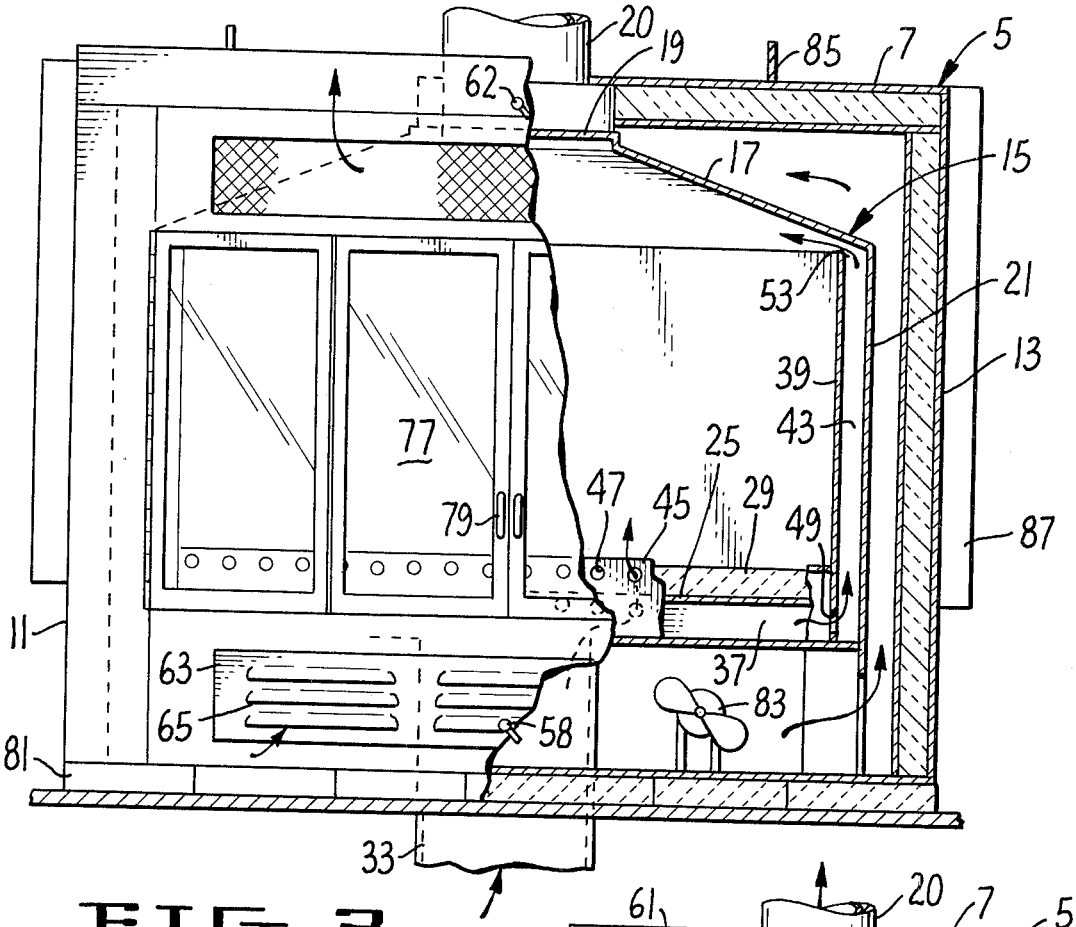
FIG. 3 is a front elevation of the fireplace, partly in section.
Figure 4:
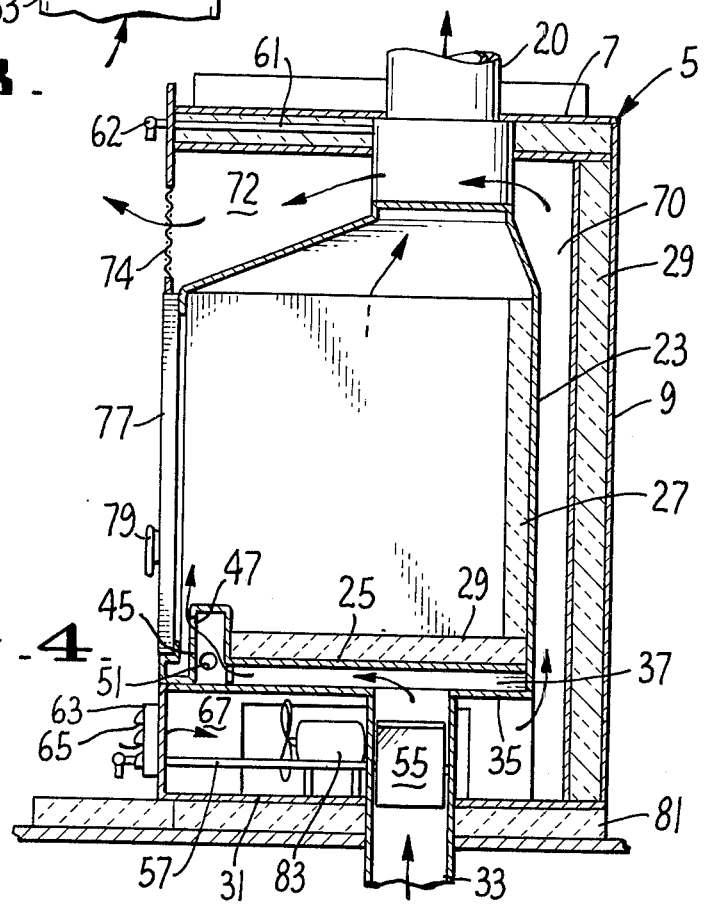
FIG. 4 is a side elevation showing the parts in section.

At each side of the firebox are baffle plates 39 and 41 and, as can best be seen in FIGS. 2 and 3, an airspace 43 is left between the side 21 and baffle 39 and a similar space, not shown, on the opposite side. Mounted at the front of the firebox is the air passage 45 and this has a plurality of holes 47 which open at the front of the fireplace and two holes 49 and 51 which open into the space 43 and the corresponding space on the opposite side. Baffles 39 and 41 do not extend completely to the top of the firebox, but there is a gap 53 at the top thereof.

Two dampers are provided. First an inlet damper 55 having a shaft 57 and handle 58 extending to the front of the fireplace, while the flue opening 19 has an outlet damper 59 having a shaft 61 and handle 62 also extending to the front of the fireplace.

Thus, the combustion air enters through the air inlet 33 wherein air is drawn from outside the room, passes the damper 55 and into the plenum 37 and the air passage 45. Here most of the combustion air is discharged through the openings 47 at the front of the fireplace so that most of the air passes up over the front doors of the fireplace, keeping them cool and clean and ensuring that combustion takes place in the front. However, a small amount of the fresh combustion air goes through the passages 49 and 51 into the space 43 where it is discharged at the top of the flames as at 53 for secondary combustion. This provision of extra air for secondary combustion ensures complete burning and prevents buildup of creosote in the chimney.

At the front of the fireplace near the bottom thereof is a removable plate 63 having a plurality of louver openings 65. Air which enters through the louvers goes into the passage 67 which is formed between the bottom of the firebox 25 and the bottom of the fireplace 31 where it can pass through the passages 69 at the sides of the fireplace and 70 at the back of the fireplace and then passes through the passage 72 at the top of the firebox and, thus, the heated air is discharged through a grill 74. It will thus be seen two entirely separately passages for air are provided. The first is a passage for combustion air from an outside source through two different routes in the firebox and out through a flue 20 and a second path for room air which is drawn into the louvers 65 passes over the sides, back and top of the firebox and is discharged from the grill 74. It should be particularly noted that there is no mixing of the combustion air and the room air.

The front of the fireplace is provided with accordian glass doors 77 which have handles 79 thereon. These accordian doors are substantially airtight so that no heat is lost from the room up the chimney, even under conditions where the fire is very low. The doors may be equipped with handles 79 and these will stay cool since the combustion air is largely introduced at the front of the firebox where it flows over the doors keeping them cool and clean.

In the embodiment shown the fireplace is illustrated as having been installed on a brick hearth 81, but this is purely for aesthetic reasons as the bottom of the fireplace is well insulated by the air passages for both the room and combustion air and the refractory 29. Thus there is no practical reason why the fireplace cannot be installed directly on a combustible floor.

Normally the fireplace of the present convention gives good circulation purely by convection, but if desired one or more blowers 83 can be installed in the air inlet passages 67. Since the front plate 63 is removable, it is easy to install and service the blowers.

Preferably upstanding flanges are provided at the top and sides of the fireplace as at 85 and 87. These are not required for insulation, but instead are merely used as guides for the builder to establish the correct dimensions for the opening in which the fireplace is installed and to hold it firmly in place.

Although a preferred embodiement of the invention has been shown, it will be understood that many variations can be made in the structure shown without departing from the spirit of this invention.

I claim:

1. A fireplace adapted to be built into a building, comprising in combination:

a. a firebox, said firebox including a combustion chamber, a double wall bottom, double wall sides, a back, and a conical top, said double wall sides being planar and having one end thereof connected to a lower wall of said double wall bottom and having an inner wall of said double wall sides spaced from but closely adjacent said conical top, said sides having fluid passages defined therein to fluidly connect said double wall sides to said double wall bottom, said walls and said bottom forming combustion air fluid passages which are located on the inside of said combustion chamber and which are fluidly connected with each other and with said combustion chamber via the top of said combustion chamber, refractory material located adjacent said combustion chamber sides and bottom, b. an outer shell having a front wall, double wall sides, a double wall top and a bottom and surrounding said firebox on at least the bottom, back, sides and top of said firebox, said shell including refractory material in said double wall sides and said double wall top, and being spaced from said firebox at said bottom, back, top and sides to define bottom, side and top room air flow passages, said flow passages being fluidly connected together, c. transparent doors on the front wall of said firebox, said doors being substantially airtight when in a closed condition, d. a main combustion air intake conduit located near said firebox back and fluidly connected to said firebox double wall bottom so that combustion air from said intake travels a substantial distance in contact with said firebox bottom, e. a damper in said main combustion air intake conduit, f. a combustion air manifold fluidly connected to said firebox double wall bottom fluid passage to receive air therefrom, said combustion air manifold being U-shaped and opening toward said bottom lower wall and being located closely adjacent but spaced from said transparent doors, said manifold supporting that refractory material located on said firebox bottom, g. air flow directing means on said air manifold located adjacent the bottom of said doors to direct combustion air from said manifold into said combustion chamber and onto the inside of said doors for providing combustion air for said combustion chamber and for cooling said doors, h. room air intake openings on the bottom of said outer shell front, said intake openings being fluidly connected to said shell bottom flow passage, i. room air exhaust openings in the top of said outer shell front and fluidly connected to said bottom flow passage so that room air flows beneath, beside, behind and on top of said firebox when passing from said intake openings to said exhaust openings, j. said shell flow passages being in direct thermal contact with said firebox fluid passages and said firebox fluid passages being in direct thermal contact with said combustion chamber so that heat from said combustion chamber is transferred to the air flowing in said fluid and said flow passages, k. a major portion of combustion air flowing from said intake conduit following said firebox flow passage to the front of the firebox, then exhausting from said air manifold flow directing means to flow in contact with said transparent doors and then the remainder of said combustion air flowing in said firebox wall fluid passages then into the top of said firebox combustion chamber to produce secondary combustion near the top of said combustion chamber thereby assuring complete combustion without combustion products being discharged through an opening at the top of the firebox, l. said air flowing over said transparent doors keeping said doors cool and clean, and m. room air flowing in said flow passages from said intake openings to said exhaust openings contacting said firebox top and serving to heat a room in which said fireplace is located.

2. The fireplace of claim 1 having an electric fan in said bottom room air flow passage.

* * * * *